US006267364B1

(12) United States Patent
Zhang

(10) Patent No.: US 6,267,364 B1
(45) Date of Patent: Jul. 31, 2001

(54) MAGNETORHEOLOGICAL FLUIDS WORKPIECE HOLDING APPARATUS AND METHOD

(76) Inventor: Xuesong Zhang, 2408 Albert Rasche Dr., Cape Girardeau, MO (US) 63071

( * ) Notice: Subject to any disclaimer, the term of this patent is extended or adjusted under 35 U.S.C. 154(b) by 0 days.

(21) Appl. No.: 09/506,890

(22) Filed: Feb. 18, 2000

Related U.S. Application Data

(63) Continuation-in-part of application No. 09/356,342, filed on Jul. 19, 1999, now Pat. No. 6,182,954.

(51) Int. Cl.[7] ..... B25B 11/00
(52) U.S. Cl. ..... 269/7
(58) Field of Search ..... 269/7, 8, 266; 252/62.52, 62.54, 62.55, 62.56

(56) References Cited

U.S. PATENT DOCUMENTS

| | | |
|---|---|---|
| 3,197,682 | 7/1965 | Klass et al. . |
| 3,660,949 | 5/1972 | Coes, Jr. . |
| 3,818,646 | 6/1974 | Peterson . |
| 3,953,013 | 4/1976 | Griffith et al. . |
| 4,033,569 | 7/1977 | Dunn . |
| 5,549,837 | 8/1996 | Ginder et al. . |
| 5,667,715 | 9/1997 | Foister . |
| 5,947,662 | 9/1999 | Becker et al. . |

*Primary Examiner*—Robert C. Watson
(74) *Attorney, Agent, or Firm*—Polster, Lieder, Woodruff & Lucchesi, L.C.

(57) ABSTRACT

A fixturing or workpiece holding and clamping apparatus or device, as well as method, utilizing the viscosity increase or solidification of a magnetorheological fluid work contacting medium to secure both regular and irregular shaped workpieces for precision machining or measuring operations. The apparatus or device comprises a perforated fixture into which the workpiece is placed in a desired position and orientation. The perforated fixture and positioned workpiece are placed in an open cell containing a magnetorheological fluid which conforms to a portion of the surface of the workpiece. A magnet then applies a magnetic field to the magnetorheological fluid to increase the viscosity thereof and to solidify the fluid around the workpiece with a uniform clamping pressure, securing the workpiece in the desired position and orientation for machining or measuring operations. A clamp configured to apply a compressive force to the solidified magnetorheological fluid optionally increases the uniform clamping pressure applied to the workpiece by compressing the solidified magnetorheological fluid to further increase viscosity and solidification thereof. The solidified magnetorheological fluid attenuates vibrations in the workpiece, and reverts to a liquid state for removal of the perforated fixture and workpiece upon removal of the compressive force and the magnetic field.

26 Claims, 11 Drawing Sheets

MAGNETORHEOLOGICAL FLUIDS WORKPIECE HOLDING APPARATUS AND METHOD

CROSS-REFERENCE TO RELATED APPLICATIONS

This is a Continuation-in-Part application of U.S. application Ser. No. 09/356,342 filed on Jul. 19, 1999, from which priority is claimed, now U.S. Pat. No. 6,182,954

STATEMENT REGARDING FEDERALLY SPONSORED RESEARCH OR DEVELOPMENT

Not Applicable.

BACKGROUND OF THE INVENTION

The present invention relates generally to a fixturing or workpiece holding and clamping device and method, and in particular, to a fixturing or workpiece holding and clamping device utilizing a viscosity increase or solidification of a magnetorheological fluid work contacting medium as a method to secure both regular and irregular shaped workpieces for precision machining or measuring operations.

The securing of irregularly shaped workpieces, such as jet engine or turbine blades having an enlarged end projecting from an elongated and considerably thinner airfoil section, for machining operations such that it does not result in damage to the workpiece has been found to be difficult. Typical methods of clamping through clamps or fixtures are not practical since they can cause permanent damage to the workpiece. As a result, the traditional solution to prevent damage to these and other irregularly shaped workpieces include encapsulation by the casting of a low melting point molten matrix material such as lead or zinc around the thin irregularly shaped portion of the workpiece, such as the airfoil section, after which the machining or measuring of the enlarged end portion is performed, as is seen in U.S. Pat. No. 5,947,662 to Becker et al. for "System For Holding Thin-walled Workpiece During Machining." Generally, this procedure involves inserting the elongated thin portion of the workpiece into a cast iron block having a cavity which is significantly larger than the workpiece itself. The molten matrix material is then poured into the cavity, surrounding and encapsulating the workpiece. After the matrix material cools and solidifies, the workpiece is secured in a fixed position for the machining or measuring operations. Upon completion of the machining or measuring operation, the matrix material is melted away from the thin irregularly shaped portion of the workpiece, leaving a finished product. This procedure, however, adds considerably to the expense of producing such workpieces, increases health and environmental risks associated with the vapors released from the molten matrix material, and fails to adequately protect the workpiece against deformation damage during the machining operations. Furthermore, such solutions cannot be applied to workpieces which are vulnerable to damage from the heating and cooling cycles associated with the addition and removal of the matrix material, or which have finished or treated surfaces which may become contaminated by residue from the molten matrix material.

Other solutions to the problem of securing irregularly shaped workpieces include the use of complex single-purpose hydraulic clamping devices such as is shown in U.S. Pat. No. 4,033,569 to Dunn for "Deformation-Preventing Workpiece-Holding Fixture for Machine Tools." These devices are typically suitable for holding only a limited range of irregularly shaped objects, and operate by applying a plurality of clamping members to a number of locations on the surface of the workpiece. Application of a clamping force to only a limited number of locations along the surface of a workpiece while retaining it during the machining operations can result in the buildup of stress or damage in the workpiece from the non-uniform application of the clamping forces.

A similar solution is exemplified by U.S. Pat. No. 3,818,646 to Peterson for "Fixture For Holding Precisely Shaped Parts" wherein an irregularly shaped workpieces, such as the thin elongated airfoil portion of a jet engine turbine blade, is secured for machining operations by a plurality of individual movable pins extending from the side wall of a clamping fixture to engage both the convex and concave surfaces of the workpiece. While increasing the number of individual movable pins extending from the side wall of the clamping fixture results in a more uniform application of clamping force to the irregularly shaped workpiece, this solution still fails to provide a completely uniform application of clamping force, and is limited to operation on workpieces having exterior surfaces with generally smooth curvature.

An alternative solution which applies a more uniform clamping pressure to the surfaces of a regular or irregular workpiece involves the use of a dry particulate material fluidized by a pressure of gas injection means for insertion of a workpiece, which is then substantially solidified by the application of a vacuum force or magnetic field to the dry particulate material. Examples of these types of fixturing devices may be found in U.S. Pat. No. 3,953,013 to Griffith et aL for "Method and Apparatus for Clamping A Workpiece In A Quasi-liquid Medium" and U.S. Pat. No. 3,660,949 to Cose, Jr., for "Work Holder For Irregular Shaped Workpieces." However, the use of a dry particulate fluidizable material or quasi-liquid requires a complicated variety of associated gas injection and vacuum generating elements, as well as containment for the dry particulate fluidizable material, since an excess of fluidizing pressure can easily expel the particulate material from the device.

A second alternative solution for applying a more uniform clamping pressure to the surfaces of a regular or irregular workpiece involves the use of electrofluids which respond to the presence of either alternating electric fields or a voltage difference by manifesting an apparent change in bulk viscosity. It is known that if these fluids are applied as a film over a dielectric surface, and an alternating electric field is applied to the fluid from beneath the surface, a workpiece placed on or in the electrofluid film causes the electrofluid to be energized by the electric field to secure the workpiece firmly in place. These devices, exemplified by U.S. Pat. No. 3,197,682 to Klass et al. require the application of a high voltage and potentially dangerous, three-phase current to the device, and do not permit workpieces to be immersed in the electrofluid film to any great depth, thereby limiting the clamping pressure of the device. Furthermore, electrorheological fluids are temperature sensitive, and typically have an inability to withstand water contamination, rendering them useless in machining applications wherein a machining tool is cooled by the application of water or other water-based liquid coolant to an exposed cutting surface.

Accordingly, there is a need in the industry for a self-contained fixturing or workpiece holding and clamping apparatus or device and method capable of securing both regular and irregularly shaped workpieces, such as jet engine turbine blades, for machining operations with a uniform clamping force so as to reduce the stresses associated with the machining operations on the workpiece, while also being easy to use, simple to construct, and which also eliminates the risk of environmental and workpiece contamination, as well as the risk to an operator's health from electric shock or the inhalation of harmful vapors or particles.

It is believed that an apparatus and method for immobilizing and securing both regular and irregularly shaped workpieces through the solidification or viscosity increase of a magnetorheological fluid subjected to a magnetic field will solve many of the problems associated with traditional work holding fixtures. It is known that in the presence of an appropriate magnetic field, solid magnetizable particles in fluids such as mineral oil, silicone oil, or other suitable organic liquid move into alignment, forming fibrous structures parallel to the applied field, significantly increasing the viscosity of the fluids and substantially decreasing the ability of the fluid to flow or be sheared.

A magnetizable carrier fluid or ferrofluid may be substituted for the mineral oil, silicone oil, or other fluid used as a carrier for the solid magnetizable particles in traditional magnetorheological fluids. While ferrofluids themselves do not solidify when subjected to an applied magnetic field, they similarly exhibit magnetic field-induced viscosity increases, and may be utilized to achieve yield stress levels significantly in excess of traditional magnetorheological fluids, as is taught by U.S. Pat. No. 5,549,837 to Ginder et al. for "Magnetic Fluid-Based Magnetorheological Fluids."

The basis for the magnetorheological effect can be explained by the inter-particle forces induced by the applied magnetic field. When an external magnetic field is applied to an initially random arrangement of magnetizable particles, a magnetic moment which is approximately parallel to the applied field is induced in each particle. The force between two particles whose moments are aligned head-to-tail is attractive, promoting the formation of chains or more complicated networks of nearly contacting particles aligned along the direction of the field, significantly increasing the viscosity and essentially solidifying the fluid. The strength of this solidified magnetorheological fluid can be characterized by the yield sheer stress at which the network of aligned particles is disrupted and the particles flow. Fluids having a high yield stress can sustain larger mechanical forces when solidified in the presence of a magnetic field before flowing. Magnetorheological fluids easily obtain yield stress values in excess of 5 psi in the presence of a magnetic field, and may be prepared to achieve yield stresses on the order of 20 psi as taught by U.S. Pat. No. 5,667,715 to Foister for "Magnetorheological Fluids." In general, for a magnetorheological fluid, it is known that an increase in the flux density of the magnetic field to which it is subjected will result in an increase in the yield stress, i.e. an increase in viscosity which in this context is understood to mean solidification.

BRIEF SUMMARY OF THE INVENTION

Among the several objects and advantages of the present invention are:

The provision of a work holding apparatus or device utilizing an increase in viscosity or solidification of a magnetorheological fluid work contacting medium to secure a workpiece;

The provision of the aforementioned work holding apparatus or device wherein the viscosity increase or solidification of the magnetorheological fluid work contacting medium is achieved by the application of a magnetic field to the magnetorheological fluid work contacting medium;

The provision of the aforementioned work holding apparatus or device wherein the workpiece is further secured by the application of a clamping force to the solidified magnetorheological fluid work medium, further increasing the viscosity of the magnetorheological fluid;

The provision of the aforementioned work holding apparatus or device wherein a decrease in viscosity of the magnetorheological fluid work contacting medium is achieved by the removal of the magnetic field;

The provision of the aforementioned work holding apparatus or device wherein the workpiece may have either a regular or irregular shape;

The provision of the aforementioned work holding apparatus or device wherein the magnetorheological fluid work contacting medium is contained within an open-faced container;

The provision of the aforementioned work holding apparatus or device wherein the magnetorheological fluid work contacting medium is encapsulated in a deformable packet;

The provision of the aforementioned work holding apparatus or device wherein the open-faced container is configured to absorb peak vibrational forces, preventing movement or climbing of the workpiece inside the work holding device;

The provision of the aforementioned work holding apparatus or device wherein the workpiece is secured for measuring or machining operations by the solidification of the magnetorheological fluid work medium;

The provision of the aforementioned work holding apparatus or device wherein the magnetorheological fluid work contacting medium attenuates vibrations induced in the workpiece by the machining operations;

The provision of the aforementioned work holding apparatus or device wherein the magnetorheological fluid work contacting medium applies a uniform clamping force to the workpiece upon solidification;

The provision of the aforementioned work holding apparatus or device wherein the apparatus or device is suited for use in securing heat sensitive and non-magnetic materials;

The provision of the aforementioned work holding apparatus or device wherein the apparatus or device is suited for use in securing both metallic and non-metallic workpieces;

The provision of the aforementioned work holding apparatus or device wherein the workpiece is not subjected to a heating and cooling cycle;

The provision of the aforementioned work holding apparatus or device wherein the emission of harmful and environmentally damaging vapors or particulate matter is significantly reduced or eliminated;

The provision of the aforementioned work holding apparatus or device wherein the apparatus or device requires no external power source;

The provision of the aforementioned work holding apparatus or device wherein the apparatus or device requires no associated fluid pressure or vacuum delivery systems;

The provision of the aforementioned work holding apparatus or device wherein the apparatus or device is readily adaptable to operate as a component in an assembly line manufacturing process; and The provision of the aforementioned work holding apparatus or device wherein the device is easy to assemble, simple to operate, and may be manufactured for a low cost.

Briefly stated, the preferred embodiment of the work holding apparatus or device of the present invention utilizes a work contacting medium comprising a magnetorheological fluid and a specifically configured work holding container or fixture to secure a workpiece of either a regular or irregular shape for machining or measuring operations without damage to the workpiece. The work holding container or holding fixture comprises a open-faced container perforated by threaded holes within which a workpiece of either a regular or irregular shape may be placed. The workpiece is secured within the container by means of screws threaded through the threaded holes to contact the surface of the workpiece with minimal force. The perforated container or holding fixture is then positioned within a open cell containing either a liquid magnetorheological fluid work contacting medium which flows around the portion of the workpiece placed within the perforated container or deformable packets of encapsulated magnetorheological fluid which conform to the surfaces of the workpiece and the open cell. The cell is located in an adjustable gap of a magnet such that a magnetic field generated by either a permanent magnet or an electromagnet will pass through the cell. The cell is constructed from two walls and a centerpiece, with each wall further constructed from two parts. The first part is made of a non-magnetic material which secures the second part made of a magnetic material in contact with the poles of the magnet. The centerpiece of the cell forms a hollow center, and holds the perforated container or holding fixture within which the workpiece is placed, in a fixed position in the cell. On either side of the centerpiece, a "U" shaped groove contains a compressible sealing material to retain the magnetorheological fluid within the cell and to permit compression of the hollow center.

Once the workpiece is secured within the container, and placed within the magnetorheological fluid in the cell, a magnetic field is applied to the magnetorheological fluid, solidifying it to apply a uniform clamping pressure to the surfaces of the workpiece immersed within the magnetorheological fluid or contacting the deformable packets. The clamping pressure may be further increased by decreasing the gap of the magnet within which the cell is placed, compressing the compressible sealing material and squeezing the solidified magnetorheological fluid within the cell. Under compression, the magnetic particles comprising the magnetorheological fluid form thick columnar structures, further increasing the viscosity or solidifying of the magnetorheological fluid. The solidified magnetorheological fluid work contacting medium supplies a uniform holding force to the workpiece, and allows the perforated container or holding fixture within which the workpiece is placed to absorb any peak forces applied to the workpiece, preventing displacement thereof during a machining or measuring operation. The solidified magnetorheological fluid further serves to attenuate any vibrations generated in the workpiece during the machining or measuring operations. Upon completion of the machining or measuring operation, the clamping pressure is withdrawn from the cell, and the magnetic field removed, thereby allowing the magnetorheological fluid to revert to a liquid state, after which the workpiece may be removed from the perforated container or holding fixture and the device reset for a subsequent use.

In addition, the present invention also relates generally to a method for immobilizing or securing a workpiece having either a regular or irregular shape wherein a portion of the workpiece is immersed in a magnetorheological fluid at a desired position and orientation or placed between deformable packets containing the magnetorheological fluid. A magnetic field is applied to the magnetorheological fluid to cause the viscosity of the fluid to substantially increase, resulting in the solidification of the magnetorheological fluid about the immersed workpiece. The increase in viscosity results in the application of a uniform holding force to the surface immersed workpiece or to any surfaces to which the deformable packets have conformed against. A clamping pressure applied to the solidified magnetorheological fluid results in an additional increase in the viscosity of the magnetorheological fluid, thereby increasing the uniform holding force on the surface of the immersed workpiece, immobilizing or securing the workpiece in place. Once immobilized or secured, the workpiece is machined or measured as desired. To remove the finished workpiece, the process is reversed. First, any clamping force applied to the solidified magnetorheological fluid is removed. Next, the magnetic field is removed, resulting in a decrease in the viscosity of the magnetorheological fluid and a reversion to a liquid state. Finally, the finished workpiece is removed from the magnetorheological fluid or from between the deformable packets.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believe to be the best mode of carrying out the invention.

Figure 1:
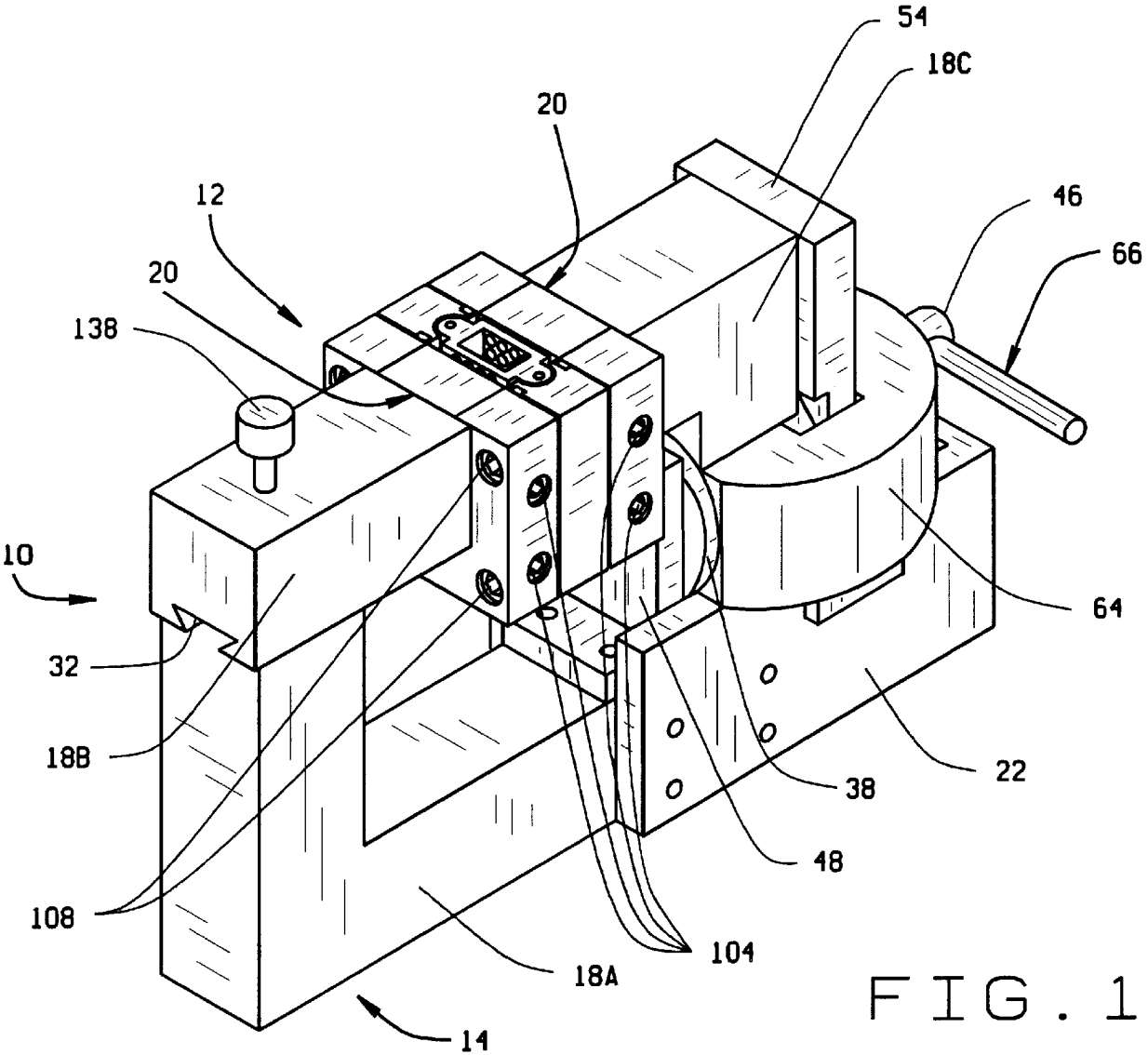
FIG. 1 is a perspective view of the work holding device of the present invention utilizing a permanent magnet to supply a magnetic field to the magnetorheological fluid.
Figure 2:
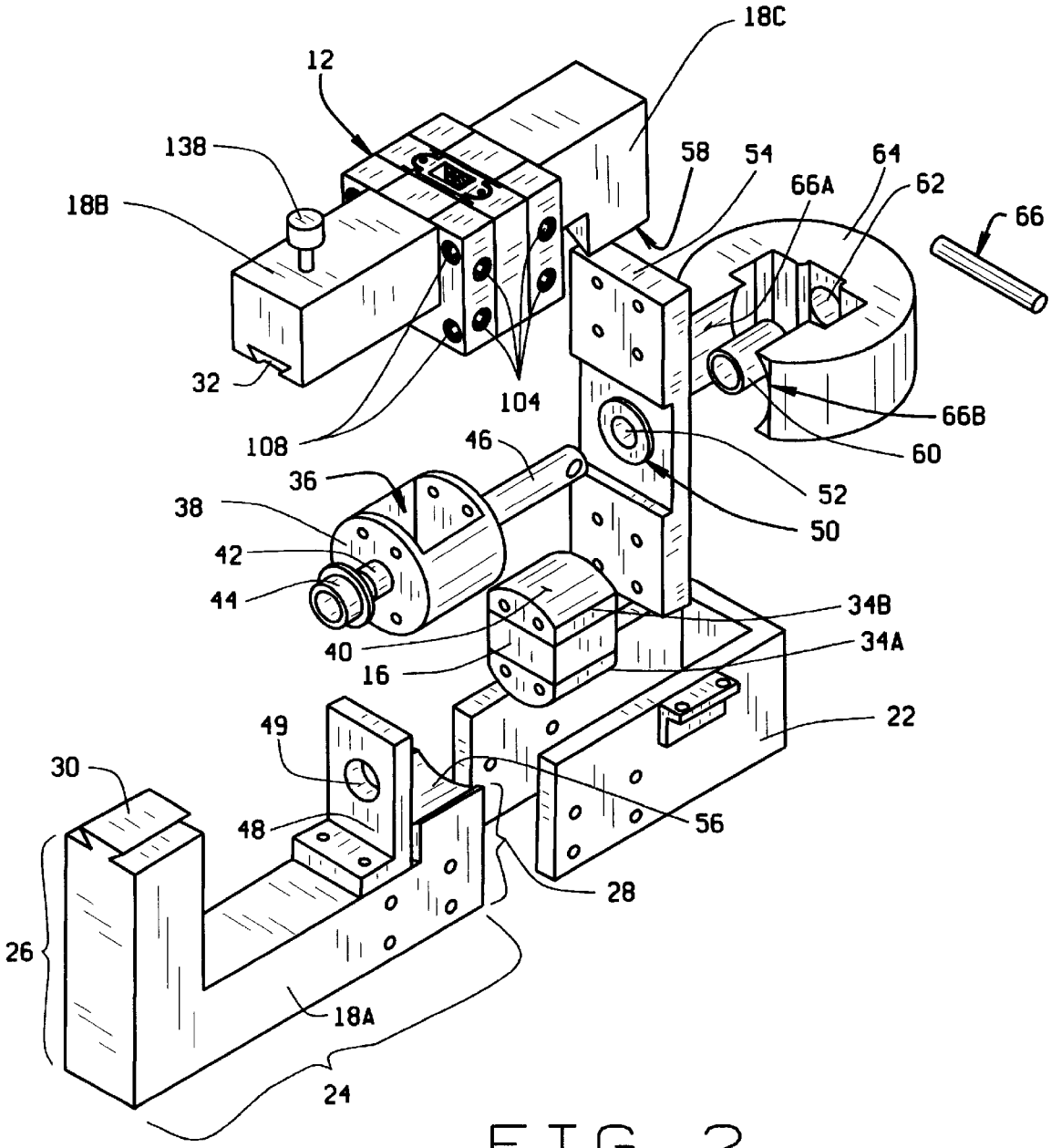
FIG. 2 is an exploded perspective view of the work holding device of FIG. 1.
Figure 3:
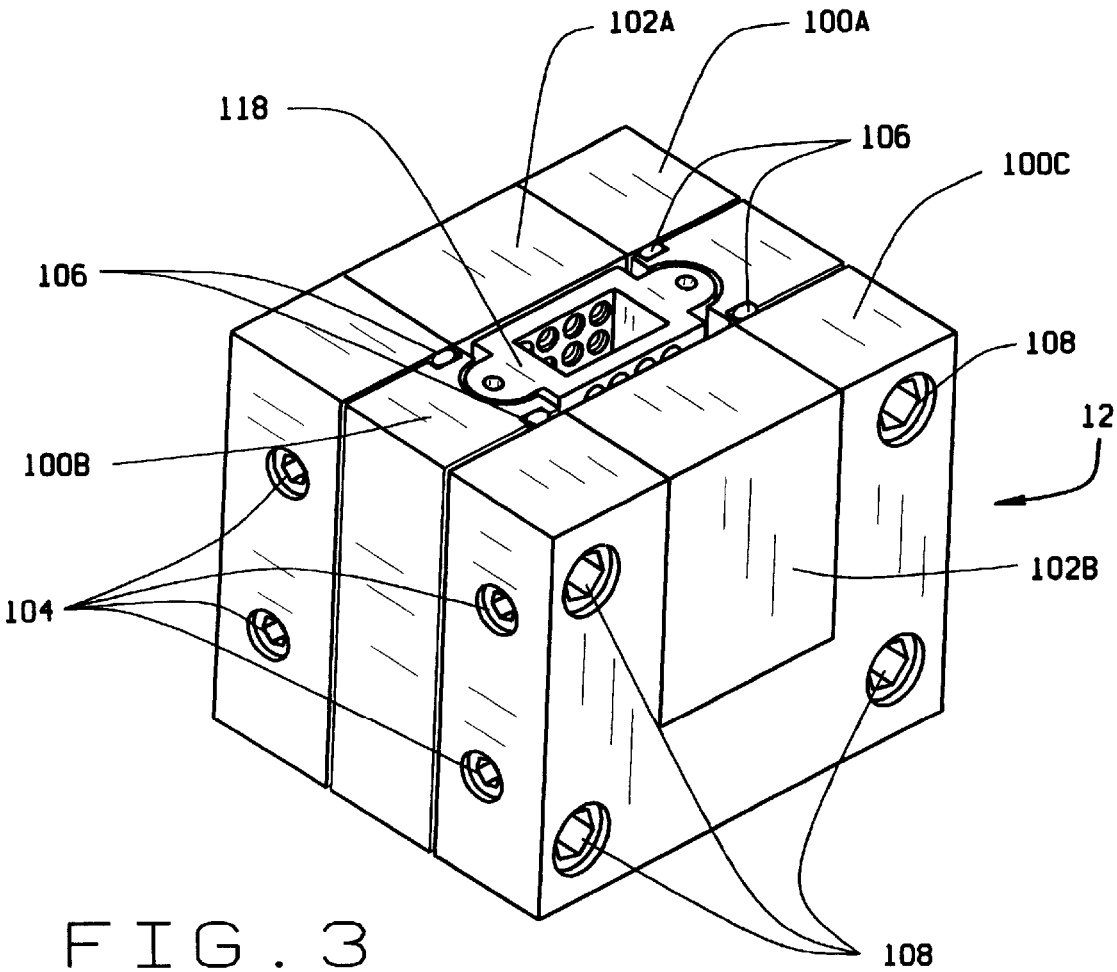
FIG. 3 is a perspective view of the magnetorheological fluid containing cell.

Turning to FIGS. 1 and 2, a preferred embodiment of the workholding device 10 of the present invention is illustrated. The workholding device 10 includes a magnetorheological (MR) fluid cell 12, and a magnetic field assembly 14. The magnetic field assembly 14 comprises a permanent magnet 16, preferably composed of rare earth alloys, as a high-strength magnetic field source secured into a square shaped arrangement of magnetic arms 18A, 18B, and 18C which are composed of a soft iron or other magnetic material having a high permeability and low residual magnetization, and which define a gap region 20. The MR fluid cell 12 is detachably secured within the gap region 20, forming a closed loop magnetic circuit with the permanent magnet 16 and the magnetic arms 18*a*, 18*b*, and 18*c*. A frame 22 secured to the magnetic arm 18A and provides a solid structure for attachment of the workholding device 10 to a workbench (not shown) or other suitable location.

As shown in FIG. 2, magnetic arm 18*a* comprises an elongated rectangular base portion 24, a first upright extension 26 at one end of the base portion 24, and a second upright extension 28 at the opposite end of the base portion 24. Both the first and second extensions 26, 28 are arrayed perpendicular to the base portion 24 in the same direction, defining a generally U-shaped member, with the first extension 26 having a greater length than the second extension 28. An upper surface of the first extension 26 includes a tongue 30 configured to engage a groove 32 on the underside of magnetic arm 18*b*, thereby permitting magnetic arm 18*b* to slide parallel to the base portion 24 of magnetic arm 18*a* while maintaining contact with the first extension 26.

As also best seen in FIG. 2, the permanent magnet 16 is preferably rectangular in shape, and enclosed on two sides by solid arch-shaped magnet shoes 34A and 34B composed of a soft iron or other good magnetic material having a high permeability and low residual magnetization. The permanent magnet 16 and the arch-shaped magnet shoes 34A and 34B are secured within a magnet receiving slot 36 passing radially through a cylindrical magnet holder 38 composed of a non-magnetic material, such that an outer surface 40 of each magnet shoe 34A, 34B is flush with, and has the same curvature as, the exterior surface of the magnet holder 38. A first support shaft 42 extends axially from an anterior surface of the cylindrical magnet holder 38, and is surrounded by a bearing bushing 44. A second support shaft 46 extends axially from a posterior surface of the cylindrical magnet holder 38. A bushing frame 48 secured to the upper surface of the magnetic arm 18A, adjacent the second extension 28 receives the first support shaft 42 and bearing bushing 44 in a receiving bore 49. The second support shaft 46 passes through a second bearing bushing 50 seated in a second receiving bore 52 in a upright connection plate 54 secured perpendicular to said frame 22 adjacent the second extension 28 of the magnetic arm 18A. The permanent magnet 16 secured within the cylindrical magnet holder 38 is thereby positioned adjacent a cylindrically concave upper surface 56 of the second extension 28, and is free to rotate through a full revolution.

Magnetic arm 18C is secured to the upright connection plate 54 above the permanent magnet 16 and cylindrical magnet holder 38. Generally L-shaped magnetic arm 18C includes a cylindrically convex surface 58 adjacent the cylindrical magnet holder 38, such that magnet holder 38 and the permanent magnet 16 are partially enclosed between surfaces 56 and 58. Magnetic arm 18C extends parallel to the elongated base portion 24 of magnetic arm 18A, towards magnetic arm 18*b*. The combined lengths of magnetic arms 18B and 18C are shorter than the length of the elongated base portion 24, thereby defining the gap region 20 into which the MR fluid cell 12 is secured, closing the magnetic circuit.

The second support shaft 46 passing through the second bearing bushing 50 extends axially though an elongated bushing 60 seated in an axial bore 62 of a horseshoe magnet 64 fitted around the upright connection plate 54 perpendicular to the plane defined by the magnetic arms 18A, 18B, and 18C. The horseshoe magnet 64 includes two cylindrical convex surfaces 66A and 66B which lie adjacent cylindrical convex surfaces 56 and 58, thereby defining a generally cylindrical chamber within which the cylindrical magnet holder 38 and permanent magnet 16 are positioned.

The distal end of the second support shaft 46 extends beyond the exterior surface of the horseshoe magnet 64, and is fitted with a perpendicular turning lever 66. Rotation of the turning lever 66 about the longitudinal axis of the second support shaft 46 causes rotation of the cylindrical magnet holder 38 and the permanent magnet 16, thereby opening the closed magnetic circuit through magnetic arms 18A, 18B, 18C, and the MR fluid cell 12. Horseshoe magnet 64 provides a second closed magnetic circuit when the magnetic field is not supplied to the MR fluid cell 12, thereby reducing energy loss in the permanent magnet 16. Rotation of the cylindrical magnet holder 38 and permanent magnet 16 by 90 degrees allows the magnetic field flowing through magnetic arms 18A, 18B, 18C, and the MR fluid cell 12 to be selectively switched on or off. In the off position, the magnetic field flows through the horseshoe magnet 64.

Turning next to FIGS. 3 through 6C, the magnetorheological fluid cell 12 is preferably constructed from three adjacent U-shaped frame sections 100A, 100B, and 100C composed of a non-magnetic material such as aluminum, brass, or stainless steel. The outermost frame sections 100A and 100C each encase a cell wall 102A, 102B on three sides. The cell walls 102A, 102B are composed of a magnetic material such as soft iron, cast iron, or other magnetic alloys having high permeability and low residual magnetization, and are secured to the frame sections by means of countersunk threaded bolts 104. When the MR cell 12 is secured between magnetic arms 18B and 18C, cell wall 102A contacts magnetic arm 18B, and cell wall 102B contacts magnetic arm 18C, allowing the magnetic field to extend into the MR cell 12. While shown in a square configuration in FIGS. 3 through 6C, it will be recognized that the cell walls 102A and 102B may be configured in any manner which will increase the strength of the magnetic field extending into the MR cell 12 by directing or focusing the magnetic flux between magnetic arms 18B and 18C into a region having an narrower cross sectional area than that of the magnetic arms 18B and 18C.

The outermost frame sections 100A and 100C includes recessed grooves 101 in the faces adjacent center frame section 100B, into which compressible seals 106 are placed to form a fluid barrier between each of said U-shaped frame sections 100A, 100B, and 100C. Countersunk threaded bolts 108 secure frame sections 100A, 100B, and 100C together, defining an open-faced volume 110 within which a magnetorheological fluid 112 is contained. The magnetorheological fluid 112 is prevented from seeping between the frame sections 100A, 100B, and 100C by the fluid barrier of compressible seals 106. The center frame section 100*b* further includes a pair of recessed regions 114A, 114B on an inner surface 116 each sized to receive a portion of workpiece holding fixture 118.

Figure 5:
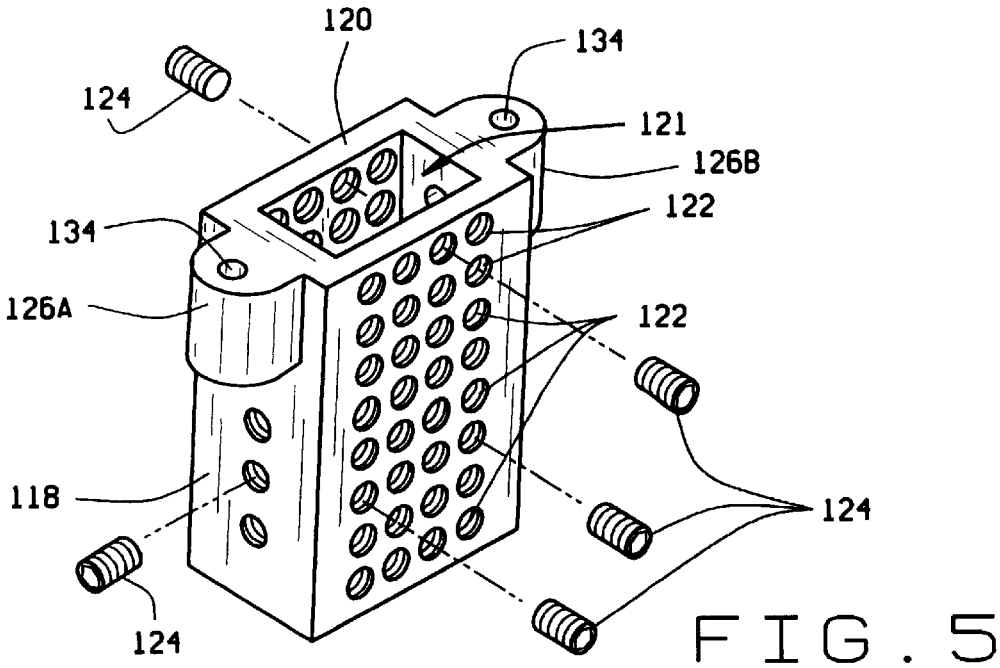
FIG. 5 is a perspective view of one embodiment of the workpiece holding fixture seen in FIG. 4.
Figure 4:
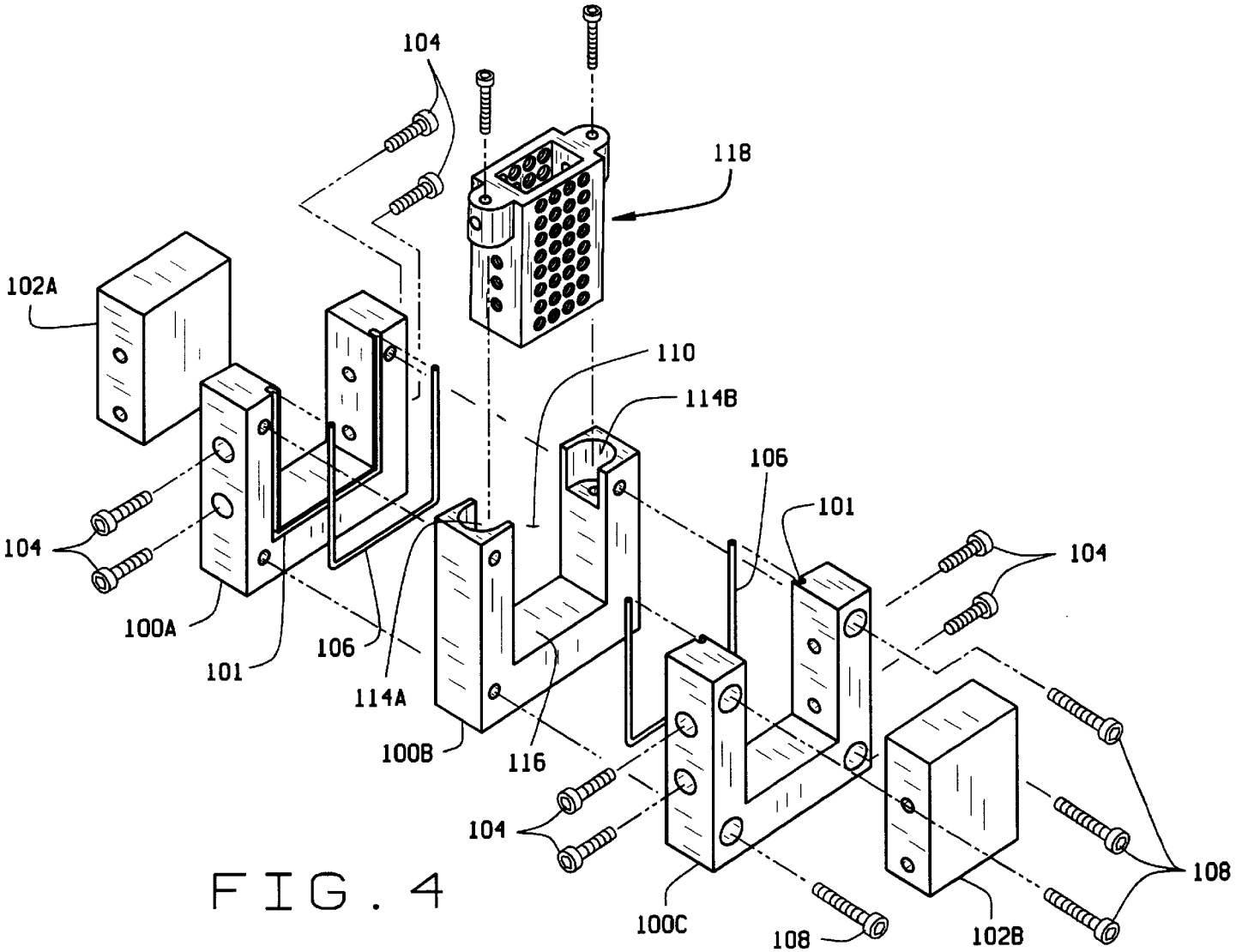
FIG. 4 is an exploded view of the magnetorheological fluid containing cell illustrating placement of a workpiece holding fixture.

The preferred embodiment of the workpiece holding fixture 118 is shown in FIG. 5, and is composed of either a magnetic or non-magnetic material. The holding fixture 118 is preferably a hollow rectangular container having an open end 120, and an interior volume 121, but may be of any shape such as cylindrical, triangular, or irregular, depending upon the size and shape of workpieces with which it is to be utilized. Opposite sides of the preferred holding fixture 118 each includes a plurality of threaded bores 122 which are axially aligned. Holding setscrews or threaded bolts 124 are seated within a number of the threaded bores 122, while a number of the bores 122 are left empty. The exterior surface of the workpiece holding fixture 118 includes a pair of hemi-cylindrical protrusions 126A and 126B configured to seat loosely within the recessed portions 114A, 114B on the inner surface 116 of the center frame section 100B.

Figure 7:
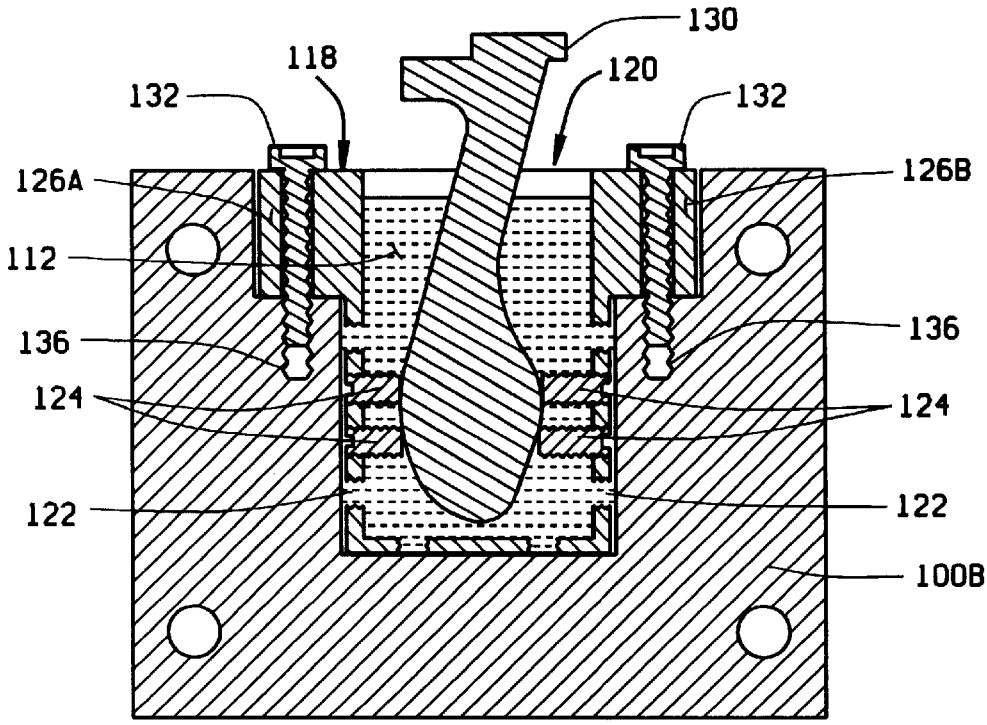
FIG. 7 is a sectional view of the view of the magnetorheological fluid containing cell of FIG. 3 and the workpiece holding fixture of FIG. 5, illustrating the workpiece holding fixture of FIG. 5 with an irregularly shaped workpiece within the workpiece holding fixture, view of the magnetorheological fluid containing cell of FIG. 3 and the workpiece holding fixture of FIG. 5, immersed in a magnetorheological fluid.

During use, a workpiece 130 to be immobilized is placed in the open end 120 of the holding fixture 118, as seen in FIG. 7, and secured in the desired position and orientation by a plurality of workpiece holding elements such as holding setscrews or threaded bolts 124 threaded in through threaded bores 122. The holding screws or threaded bolts 124 contact the surface of the workpiece 130 with a minimum force necessary to hold the workpiece 130 in the desired position and orientation, and are preferably utilized in pairs from opposite sides of the holding fixture 118, thereby absorbing peak forces and minimizing distortion of the workpiece 130. It is preferred that the holding screws or threaded bolts 124 be composed of a soft material, such as Teflon™, to avoid damage to the surface of the workpiece 130. In any case, the hardness of the holding setscrews or threaded bolts 124 is less than the harness of the workpiece 130 to avoid workpiece damage. The number of setscrews or threaded bolts 124 utilized depends upon the size and geometry of the workpiece 130. The remaining threaded bores 122 are left empty. It will be readily apparent to one of ordinary skill in the art that a variety of workpiece holding elements other than holding setscrews or threaded bolts 124 may be utilized to secure the workpiece 130 at the desired position and orientation. For example, shims, wedges or cams may be utilized separately or together with holding setscrews or threaded bolts 124, as well as other commonly known holding elements. Correspondingly, various thread-locking fluids or materials may be employed to secure the holding setscrews or threaded bolts 124 in position, preventing accidental unthreading thereof.

Figure 6A:
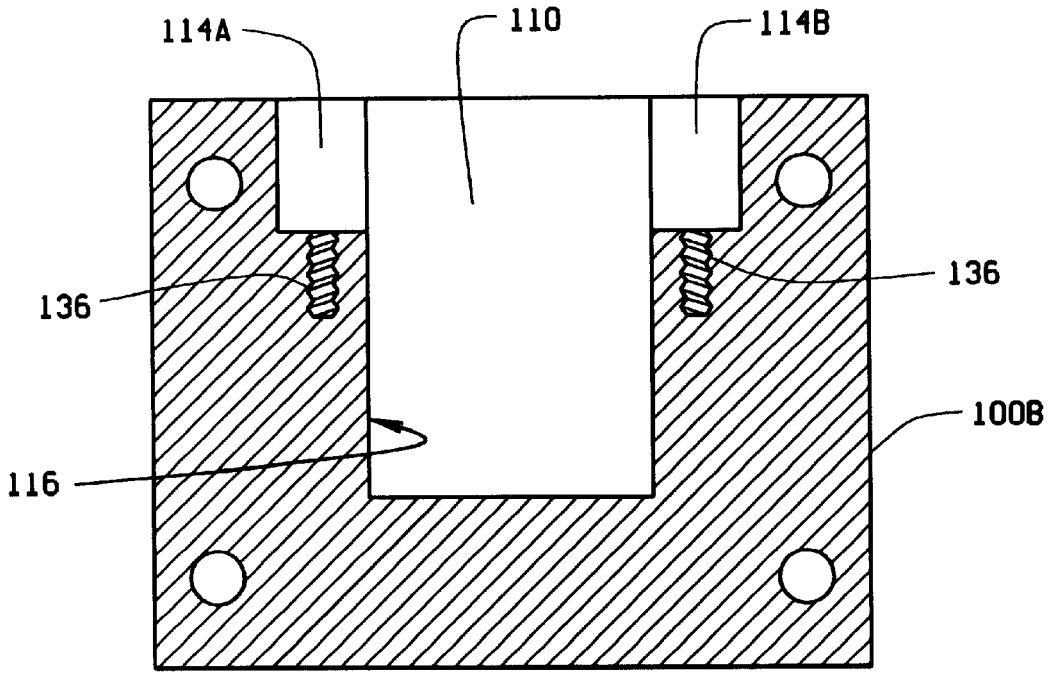
FIG. 6A is a sectional view of the magnetorheological fluid containing cell of FIG. 3.
Figure 6B:
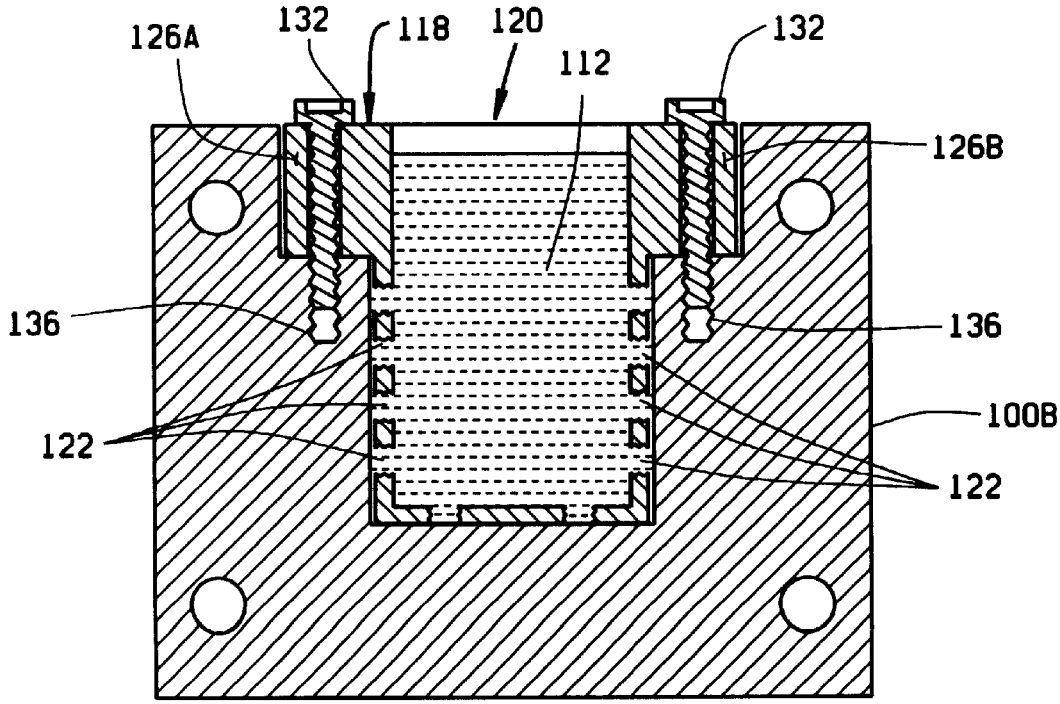
FIG. 6B is a sectional view of the magnetorheological fluid containing cell of FIG. 3 and the workpiece holding fixture of FIG. 5, illustrating the workpiece holding fixture of FIG. 5 immersed in a magnetorheological fluid.
Figure 6C:
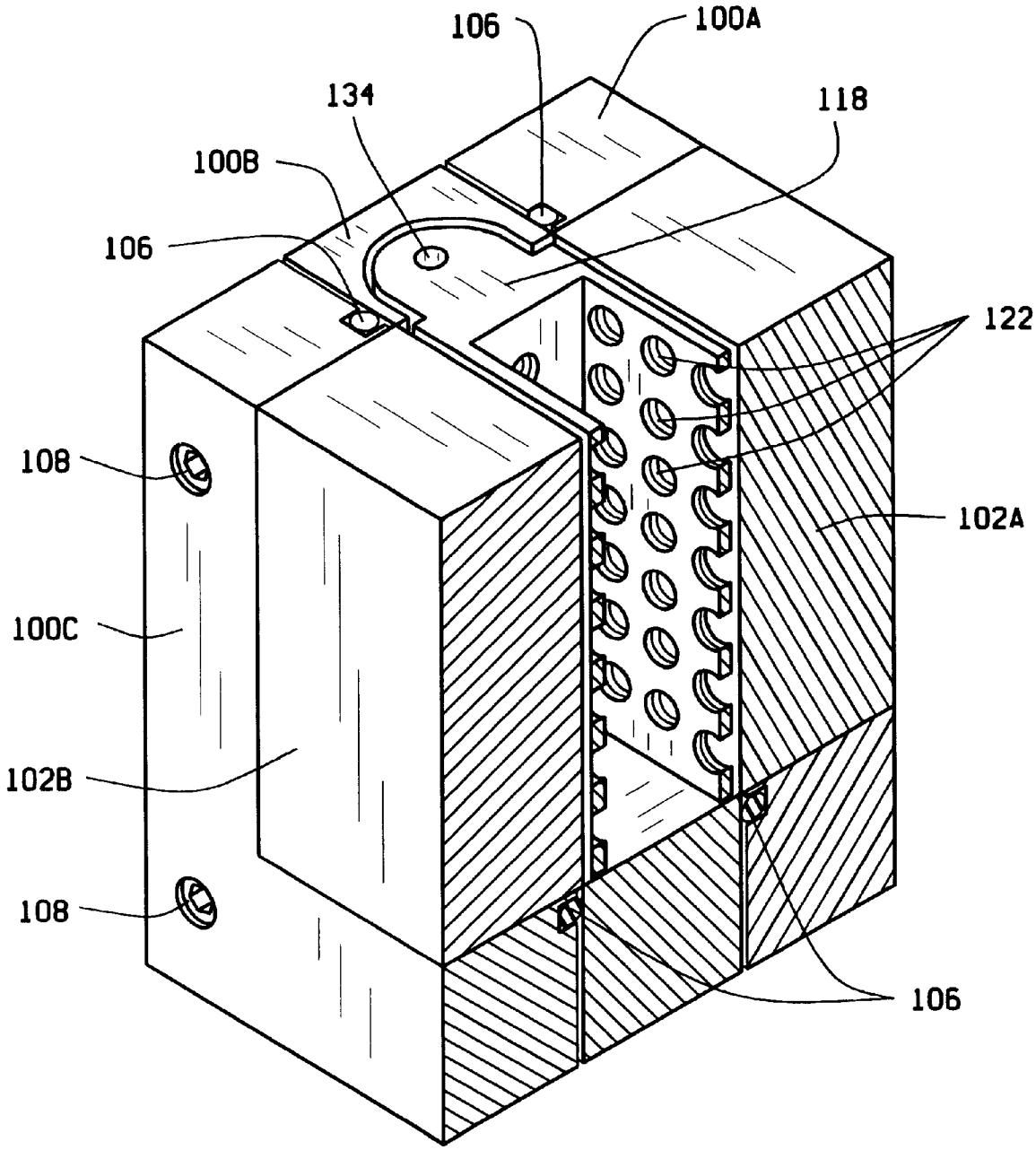
FIG. 6C is a cut-away view of the magnetorheological fluid containing cell of FIG. 3 and the workpiece holding fixture of FIG. 5, illustrating the placement of the workpiece holding fixture in FIG. 5.

Next, as best seen in FIG. 6B, the open-faced volume 110 in the magnetorheological fluid cell 12 is partially filled with the magnetorheological fluid 112 to a level at or below the upper surface of the volume 110. It is preferred that the magnetorheological fluid utilized with the present invention be a mixture of carbonyl iron powder in silicon oil with a volume percentage of powder being 20% or more, and with the powder particles being generally spherical in shape and having a mean size of approximately 5 $\mu$m. However, any magnetorheological fluid such as is described in U.S. Pat. No. 5,549,837 to Ginder et al. for "Magnetic Fluid-Based Magnetorheological Fluids" which will alter viscosity to a solid or near solid state upon application of a magnetic field may be used. An alternative class of magnetorheological fluids is disclosed in U.S. Pat. No. 5,667,715 to Foister for "Magnetorheological Fluids" and utilizes powdered magnetizable solids of at least two different sizes dispersed in a base carrier liquid to substantially increase the yield stress of the magnetorheological fluid in the presence of a magnetic field.

Once the open-faced volume 110 is partially filled with the magnetorheological fluid 112, the holding fixture 118 and secured workpiece 130 are immersed within the magnetorheological fluid 112 until the protrusions 126A, 126B of the holding fixture seat within the recessed regions 114A, 114B on the inner surface 116 of the center frame section 100B. The magnetorheological fluid is free to flow through the unused threaded bores 122 and surround or immerse a portion of the workpiece 130 and holding fixture 118. Retaining bolts 132 may be passed through bores 134 in the holding fixture 118 to threaded receiving bores 136 in the center frame 100B, thereby securing the holding fixture 118 into the magnetorheological fluid cell 12.

If the magnetorheological fluid cell 12 is not already secured into the gap region 20 between magnetic arms 18B and 18C, it is secured therein such that the cell walls 102A and 102B are in contact with the respective magnetic arms.

To solidify the magnetorheological fluid, a magnetic field is applied to the magnetorheological fluid by closing the magnetic circuit defined by the magnetic arms 18A, 18B, 18C, the MR cell 12, and the permanent magnet 16. The magnetic circuit is closed when the permanent magnet 16 of the preferred embodiment is rotated to a first position bringing the poles of the permanent magnet 16 into alignment with magnetic arms 18A and 18C, and opened when the permanent magnet 16 is rotated 90 degrees to a second position, bringing the poles of the permanent magnet 16 into alignment with the cylindrical convex surfaces 66A and 66B of horseshoe magnet 64. When in the closed position, the magnetic field significantly increases the viscosity of the magnetorheological fluid to a solid or near solid state, applying a uniform holding force between surfaces of the workpiece 130, the holding fixture 118 immersed therein, and the MR cell 12, immobilizing the workpiece 130 for machining or measuring operations. The solidified magnetorheological fluid further serves to attenuate vibrations in the workpiece 130 during machining or measuring operations, while the holding fixture 118 absorbs or attenuates peak vibration forces transmitted through the workpiece 130. For measurement and some simple machining operations, solidifying the magnetorheological fluid 112 may be all that is necessary. However, for most machining operations, the use of the holding fixture 118 and further compression of the solidified magnetorheological fluid 112, as described further below is typically required.

Upon completion of the machining or measuring operations, the magnetic circuit is opened, by rotating the permanent magnet of the preferred embodiment to the open position, diverting the magnetic field away from the magnetorheological fluid 112. The holding fixture 118 and workpiece 130 are removed by reversing the insertion operations.

Figure 8B:
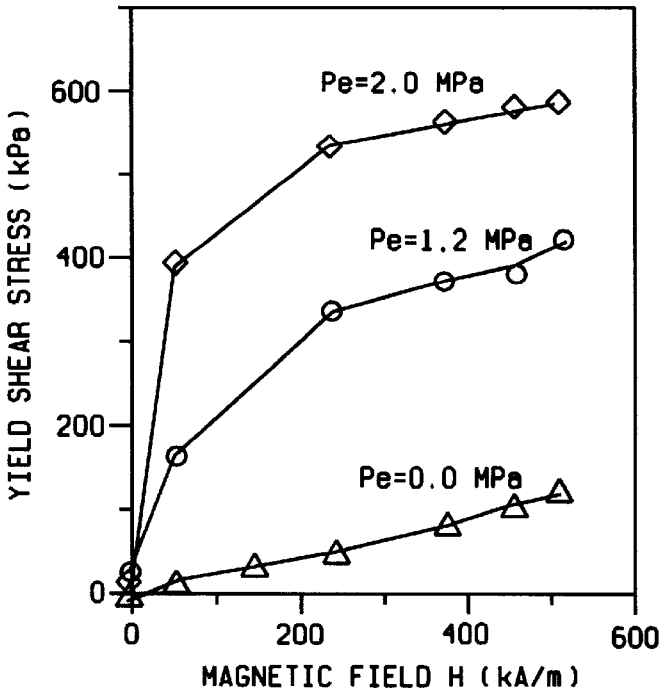
FIG. 8B is a graphical representation of yield shear stress versus magnetic field strength for a magnetorheological fluid at different levels of compression, illustrating an increase in yield shear stress for a given magnetic field strength in response to an increased level of compression.
Figure 8A:
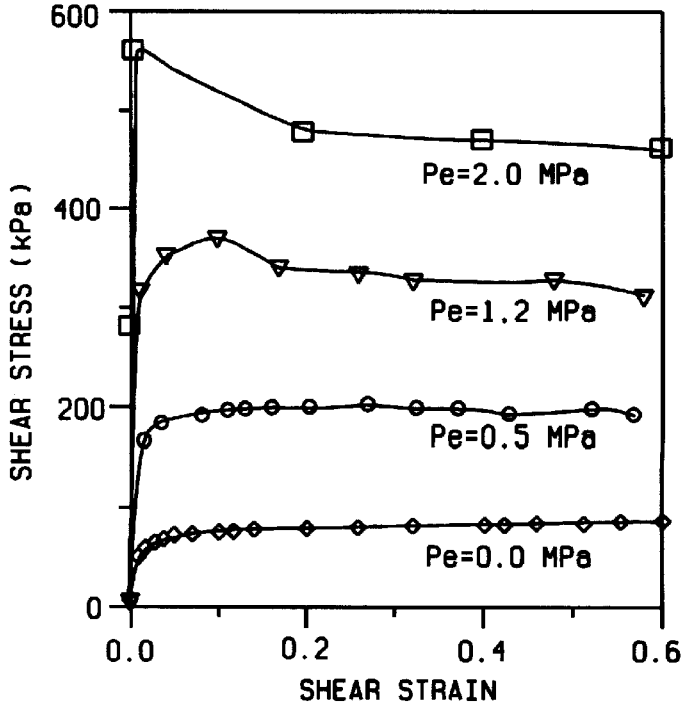
FIG. 8A is a graphical representation of shear stress versus shear strain for a solidified magnetorheological fluid at different levels of compression, illustrating increased shear stress levels for a given shear strain level in response to increased level of compression.
Figure 8C:
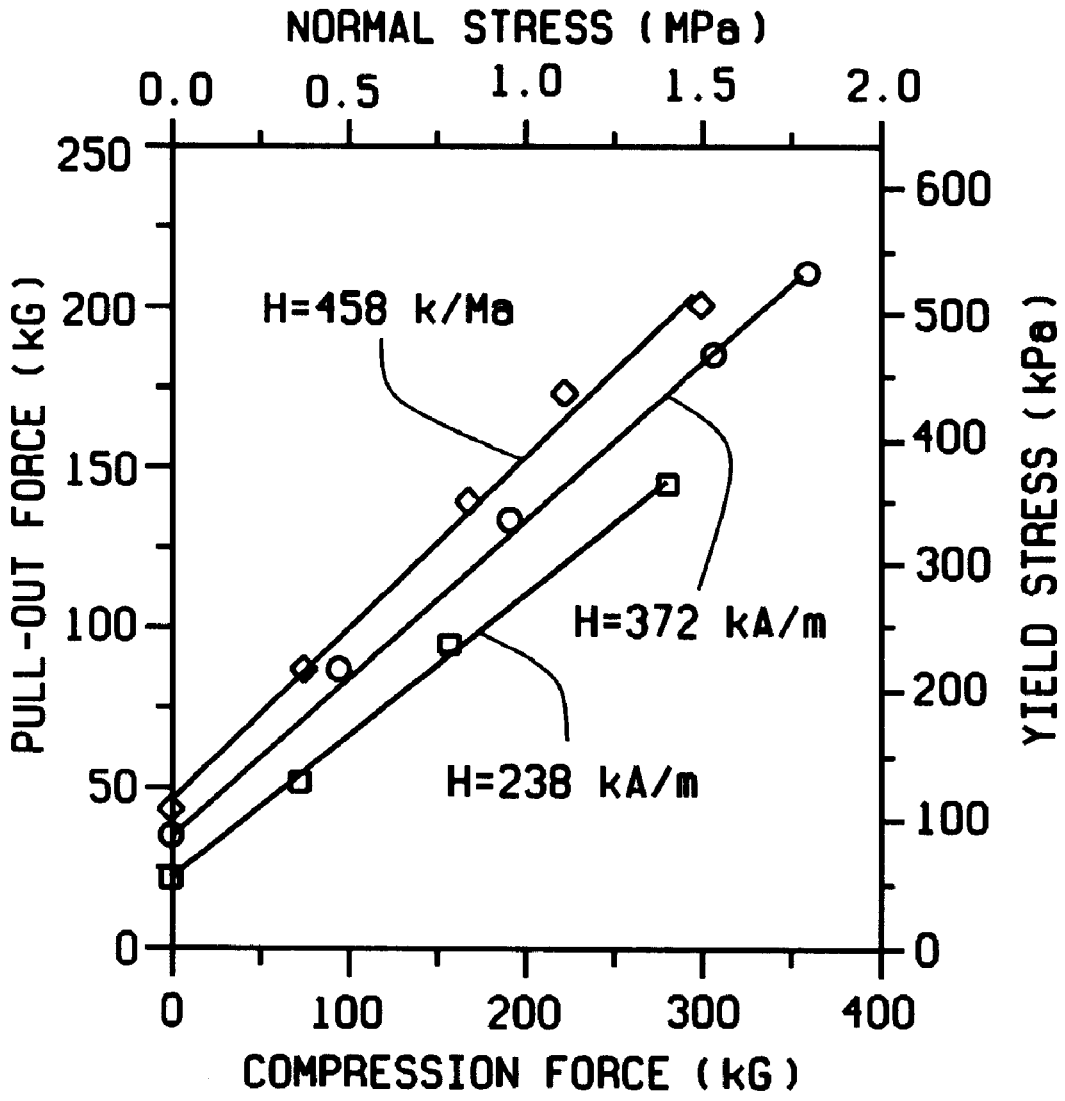
FIG. 8C is a graphical representation of pull-out force and yield stress versus compression force and normal stress for a magnetorheological fluid subjected to different magnetic field strengths, illustrating an increase in pull-out force and yield stress for a given level of compression force in response to an increase in magnetic field strength.

In the preferred embodiment, the uniform holding force applied to the workpiece 130 immersed in the magnetorheological fluid 112 is further increased by the application of a compressive force to the solidified magnetorheological fluid 112. Applying a force to the magnetic arm 18B in the direction of the MR fluid cell 12 and in the direction of the magnetic field causes movement of the magnetic arm 18B along the tongue and groove connection with magnetic arm 18A as the compressible seals 106 between the frames 100A, 100B, and 100C of the MR fluid cell 12 are compressed, decreasing the volume defined by the interior of the MR fluid cell 12. Compression of the seals 106 in turn applies a compressive force on the solidified magnetorheological fluid in the direction of the magnetic field, further increasing the viscosity of the magnetorheological fluid by causing the magnetic particles suspended in the magnetorheological fluid to form thick columnar structures, correspondingly increasing the uniform holding force immobilizing the workpiece 130 as is illustrated graphically in FIGS. 8A–8C. Once a desired level of compression is reached, a lockbolt 138 in magnetic arm 18B may be tightened, securing the magnetic arm 18B in the altered position to maintain the force on the solidified magnetorheological fluid, and the compressive force removed. To release the force, the lockbolt 138 is loosened and the magnetic arm 18B withdrawn from the altered position prior to the removal of the magnetic field from the magnetorheological fluid.

Figure 9:
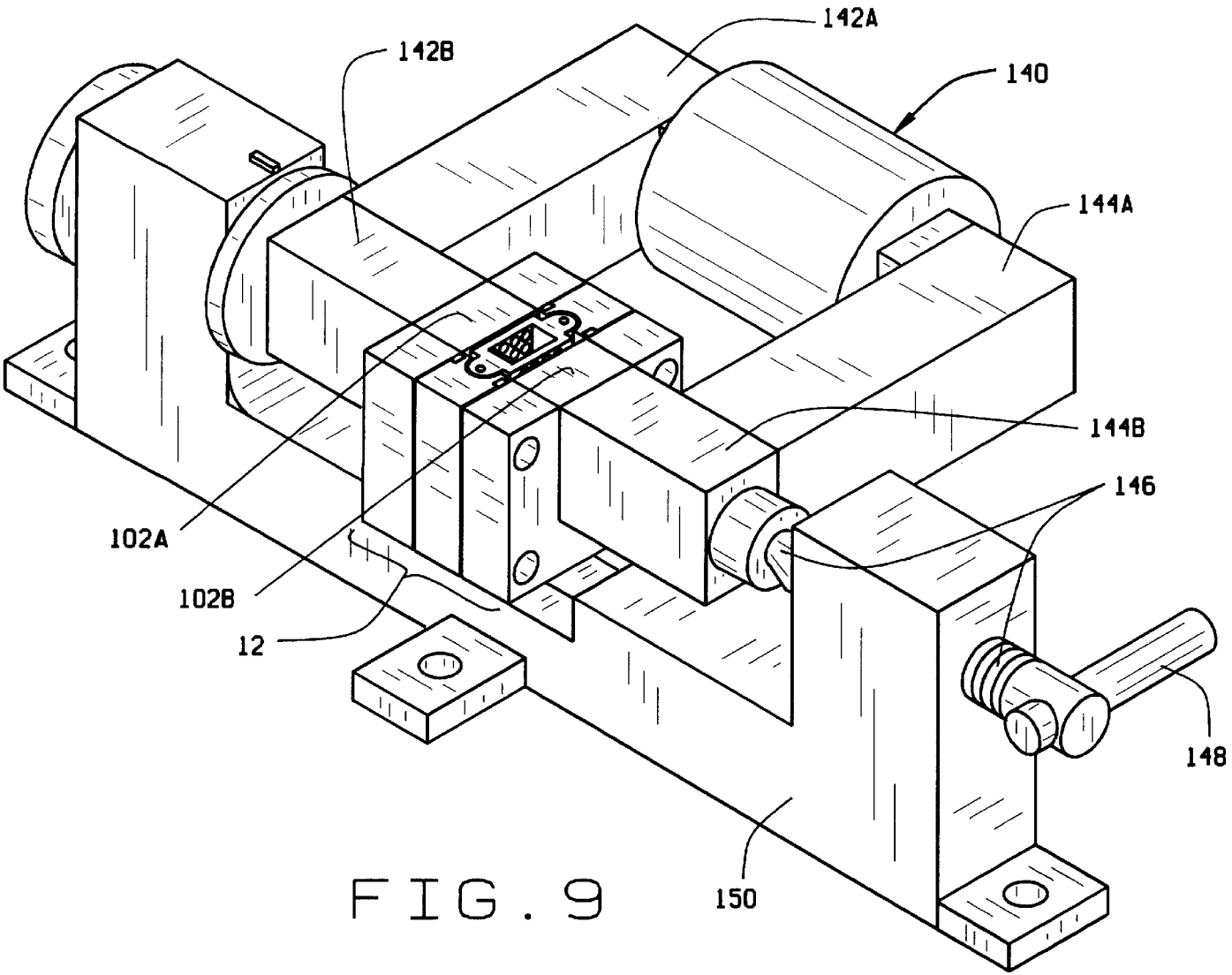
FIG. 9 is a perspective view of an alternate embodiment of the work holding device of the present invention utilizing an electromagnet to supply a magnetic field to the magnetorheological fluid.
Figure 10A:
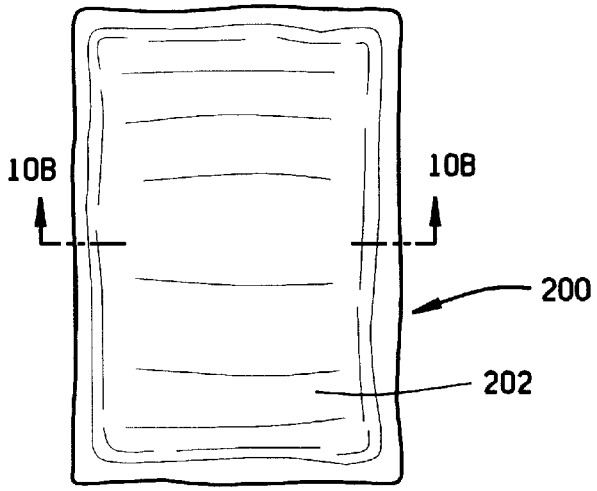
FIG. 10A is a perspective view of deformable packet containing a volume of magnetorheological fluid.
Figure 10B:
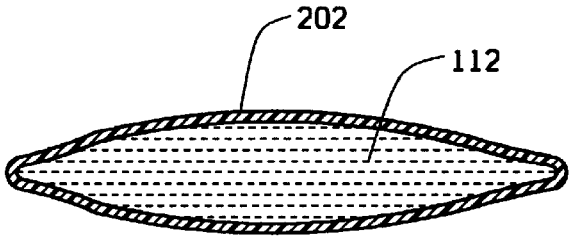
FIG. 10B is a sectional view of the deformable packet of FIG. 10A.

Those of ordinary skill in the art will recognize that any suitable magnetic field source and magnetorheological fluid may be utilized in the workholding device of the present invention, provided that the magnetic field through the magnetorheological fluid work holding material may be selectively introduced and removed. For example, FIG. 9 illustrates an alternate embodiment of the apparatus or device of the present invention utilizing an switchable electromagnet 140 in place of the permanent magnet 16. Applying an electrical current to the electromagnet 140 results in the generation of an electromagnetic field, and the closure of the magnetic circuit defined by the magnetic arms 142A, 142B, 144A, 144B, the MR fluid cell 12, and the magnetorheological fluid contained therein. In such an alternate embodiment, mechanical components associated with the rotation of the permanent magnet 16 and the second magnetic circuit defined by 16, 64 are not necessary, as removal of the electrical current supplied to the electromagnet 140 will result in removal of the electromagnetic field from the MR fluid cell 12.

Additionally shown in FIG. 9 is an alternative arrangement for applying a compressive force to the magnetorheological fluid cell 12. The tongue 30 and groove 32 interface between magnetic arms 18A and 18B of the preferred embodiment is replicated between magnetic arms 144A and 144B, and is actuated by a threaded piston 146. Rotation of the threaded piston 146 by means of a handle 148 advances or withdraws the face of the magnetic arm 144B to and from contact with cell wall 102*a* of the magnetorheological fluid cell 12, while maintaining contact between magnetic arms 144A and 144B, correspondingly applying or removing a compressive force on the magnetorheological fluid cell 12.

One of ordinary skill in the art will recognize that numerous mechanical configurations of the present invention are possible. For example, FIG. 9 illustrates the use of an alternative support base 150. Similarly, numerous configurations utilizing either permanent magnets or electromagnets to selectively apply a magnetic field to the volume of magnetorheological fluid 112 contained within an open cell are possible, resulting in the solidification of the magnetorheological fluid about a workpiece immersed therein. Similarly, a variety of well known mechanical and hydraulically actuated configurations for applying a compressive force to the solidified magnetorheological fluid contained within the open cell are possible. For example, an external clamping force may be applied in-line with the magnetic field flowing between the cell walls 102A, 102B, or such external clamping force may be applied to the magnetorheological fluid cell 12 parallel to, but external to the magnetic field through the frame members comprising the magnetorheological fluid cell 12.

Figure 11:
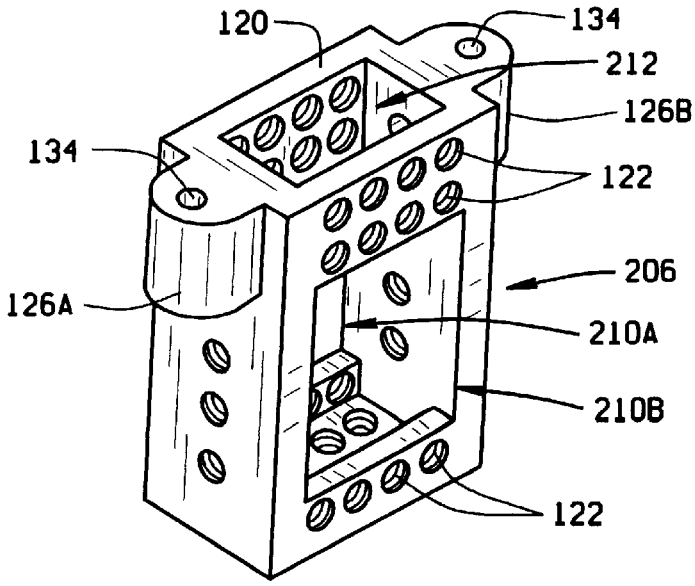
FIG. 11 is a perspective view of an alternate work holding fixture for use with the deformable packet of FIG. 10A.
Figure 12:
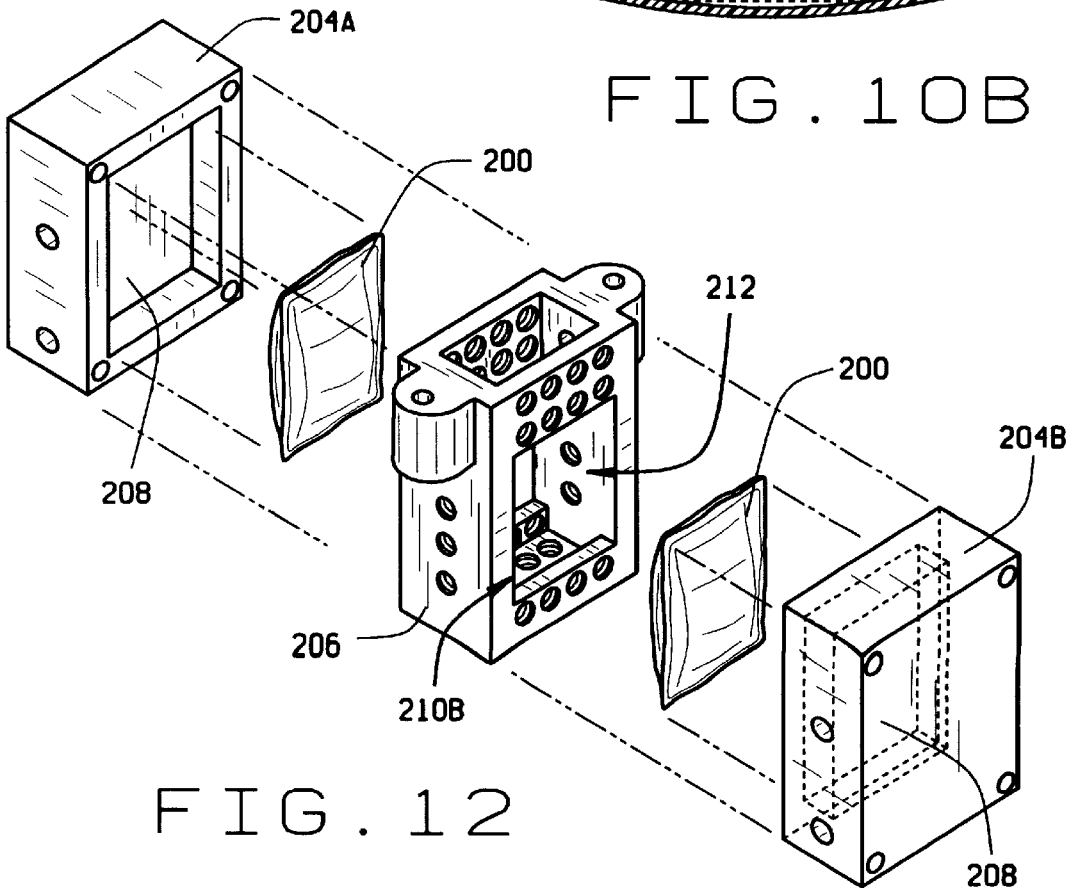
FIG. 12 is an exploded view of alternate cell wall components, deformable packets of FIG. 10A, and the alternate work holding fixture of FIG. 11, illustrating placement thereof in a magnetorheological fluid cell.

Turning to FIGS. 10A through 12, an alternative embodiment suited for use in mass production or assembly line manufacturing applications is shown in which the magnetorheological fluid cell 12 is modified to accept and utilize deformable packets 200 encapsulating the magnetorheological fluid 112 in a thin flexible membrane 202 such as latex or other flexible material in place of filling the volume 110 of the MR fluid cell 12. It will be recognized that the exact size and shape of the deformable packets 200 may be configured to conform closely to the surface of a workpiece 130, or may be of a generic rectangular shape suitable for use with a variety of different workpieces 130 having different configurations or shapes. Referring to FIGS. 11 and 12, modified cell walls 204A, 204B replace cell walls 102A, 102B in the MR fluid cell 12, and a workpiece holding fixture 206 configured for use with at least two packets 200 replaces workpiece holding fixture 118. Each cell wall 204A, 204B includes a recessed cavity 208 on an interior face configure to receive a portion of a packet 200. Workpiece holding fixture 206 includes packet receiving openings 210A, 210B on opposite faces, opening to an interior volume 212. The dimensions of each packet receiving opening 210A, 210B are preferably smaller than the dimensions of the corresponding face defining the interior volume 212 of the work holding fixture 206, such that a number of threaded perforations 122 passing through the work holding fixture 206 into the interior volume 212 are located both above and below each packet receiving opening 210A, 210B.

During use of the alternate embodiment of the magnetorheological fluid cell 12, a workpiece 130 is secured into the interior volume 212 of the workpiece holding fixture 206 at a desired position and orientation with setscrews 124 as before. Next a packet 200 is placed in each packet receiving opening 210A, 210B, such that the flexible membrane 202 contacts and conforms to the surface of the workpiece 130 secured within the interior volume 212 of the workpiece holding fixture 206. The combination of the workpiece holding fixture 206, secured workpiece 130, and packets 200 is placed into the MR fluid cell 12. The flexible membrane 202 of each packet 200 contacts and conforms to the surface of cell walls 204A, 204B, expanding into recessed cavities 208, filling all or most of the remaining volume of the MR fluid cell 12. Prior to the application of the magnetic field, it may be desirable to initially compress the flexible membrane 202 of each packet 200 to eliminate all voids and/or air pockets. Application of a magnetic field results in an increase in the viscosity of the encapsulated magnetorheological fluid, exerting a uniform clamping force on the portion of workpiece 130 in contact with the flexible membrane 202 of each packet 200. Those of ordinary skill in the art will recognize that an equal and opposite force is exerted on the cell walls by the encapsulated magnetorheological fluid 112. Applying a compression force to the MR fluid cell 12 and accordingly to the magnetorheological fluid 112 encapsulated in the deformable packets 200 results in an additional increase in the viscosity of the magnetorheological fluid, further increasing the uniform clamping force applied to the workpiece 130 secured in the workpiece holding fixture 206.

As a method, the present invention preferably incorporates the steps of (1) immersing a portion of a workpiece in a magnetorheological fluid at a desired position and orientation, and (2) applying a magnetic field to the magnetorheological fluid to increase the viscosity of, or solidify, the magnetorheological fluid, thereby applying a uniform holding force to the workpiece and immobilizing or securing it at the desired position and orientation during the application of the magnetic field. The magnetorheological fluid may further serve to attenuate vibrations in the workpiece.

In a first alternative method, the workpiece may be secured in the desired position and orientation in a holding fixture with a minimum of force, and the combination of the holding fixture and a portion of the workpiece immersed in the magnetorheological fluid prior to the application of the magnetic field. Upon the increase in viscosity or solidification of the magnetorheological fluid responsive to the application of the magnetic field, the magnetorheological fluid will apply a uniform holding force to the fixture and to the workpiece while the fixture absorbs peak vibration forces applied to the workpiece, thereby immobilizing or securing the workpiece at the desired position and orientation during the application of the magnetic field.

In a second alternative method, the workpiece may be located in the desired position and orientation in an open cell, either directly or by means of a holding fixture, with a minimum of force in an open cell, and a deformable packet encapsulating a magnetorheological fluid conformed between a surface of said workpiece and said open cell. A magnetic field is then applied to said encapsulated magnetorheological fluid, resulting in an increase in viscosity or solidification of the magnetorheological fluid and the exertion of a uniform holding force between the surface of said workpiece and said open cell, holding the workpiece at the desired position and orientation.

An additional step may be applied to the methods of the present invention to further increase the uniform holding force applied to the workpiece or to the fixture and workpiece combination by the solidified magnetorheological fluid by incorporating the application of a first compressive force to the magnetorheological fluid during or after the application of the magnetic field. It is preferred that the first compressive force act on the magnetorheological fluid in the general direction of the magnetic field, thereby resulting in an additional increase in the viscosity of the magnetorheological fluid by altering the physical arrangement of the magnetized particles suspended in the fluid carrier. Increasing the viscosity of the magnetorheological fluid results in an increase in the uniform holding force applied to the immersed portion of the workpiece, as well as the combination of the fixture and workpiece, thereby further securing the workpiece at the desired position and orientation. For applications utilizing a magnetorheological fluid encapsulated in a deformable packet, the application of the compressive force has the same effect on the magnetorheological fluid, and results in an increase in the uniform holding force exerted on the portion of the workpiece to which the deformable packet has conformed. A second compressive force may be applied perpendicular to the first compressive force to achieve further increases in the viscosity of the magnetorheological fluid.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. An apparatus for holding at least one workpiece comprising:

an open cell defining a volume containing a magnetorheological fluid conforming to a surface of said at least one workpiece, said open cell including at least one compressible member defining said volume; and means to reversibly solidify said volume of magnetorheological fluid, thereby immobilizing said at least one workpiece.

2. The holding apparatus of claim 1 further including a clamping element for applying a compressive force to said compressible member to decrease said volume containing said magnetorheological fluid and cause said magnetorheological fluid to undergo an increase in viscosity in response to said compression.

3. An apparatus for holding at least one workpiece comprising:

an open cell defining a volume containing a magnetorheological fluid conforming to a surface of said at least one workpiece;

means to reversibly solidify said volume of magnetorheological fluid, thereby immobilizing said at least one workpiece; and a perforated fixture having a plurality of workpiece holding elements to secure said at least one workpiece in a desired position and orientation, said perforated fixture having an exterior volume smaller than said open cell volume such that said perforated fixture seats within said open cell volume and is at least partially immersed in said magnetorheological fluid together with said at least one workpiece secured at said desired position and orientation.

4. An apparatus for holding at least one workpiece comprising:

an open cell defining a volume containing a magnetorheological fluid conforming to a surface of said at least one workpiece; and means to reversibly solidify said volume of magnetorheological fluid, thereby immobilizing said at least one workpiece;

wherein said magnetorheological fluid is encapsulated within at least one deformable packet, said at least one deformable packet conforming to said surface of said at least one workpiece.

5. The holding apparatus of claim 4 further including a perforated fixture having a plurality of workpiece holding elements to secure said at least one workpiece in a desired position and orientation, said perforated fixture configured to seat within said open cell volume, said perforated fixture further having at least one packet receiving opening to receive said deformable packet, said packet receiving opening exposing, to said deformable packet, a surface of said at least one workpiece secured at said desired position and orientation.

6. An apparatus for holding one or more workpieces of various shapes comprising:

an open cell defining a volume containing a magnetorheological fluid into which one or more workpieces are partially immersed;

a magnet configured to selectively apply a magnetic field to said magnetorheological fluid in said volume of said open cell to solidify said magnetorheological fluid in response to the application of said magnetic field, thereby immobilizing said one or more workpieces; and a clamping element securing said open cell, said clamping element configured to apply a compressive force to said open cell, thereby decreasing said volume and exerting pressure on said magnetorheological fluid.

7. An apparatus for holding one or more workpieces of various shapes comprising:

an open cell defining a volume containing a magnetorheological fluid into which one or more workpieces are partially immersed;

a magnet configured to selectively apply a magnetic field to said magnetorheological fluid in said volume of said open cell to solidify said magnetorheological fluid in response to the application of said magnetic field, thereby immobilizing said one or more workpieces; and wherein said open cell includes at least one compressible member, said compressible member compressing in response to application of said compressive force, thereby reducing said volume.

8. An apparatus for holding one or more workpieces of various shapes comprising:

an open cell defining a volume containing a magnetorheological fluid into which one or more workpieces are partially immersed;

a magnet configured to selectively apply a magnetic field to said magnetorheological fluid in said volume of said open cell to solidify said magnetorheological fluid in response to the application of said magnetic field, thereby immobilizing said one or more workpieces; and a fixture for securing said one or more workpieces in a predetermined position and orientation, said fixture configured for at least partial immersion in said magnetorheological fluid in said volume of said open cell.

9. The holding apparatus of claim 8 wherein said fixture includes a plurality of perforations through which said magnetorheological fluid can flow, a portion of said plurality of perforations containing holding members for securing said one or more workpieces in a predetermined position and orientation.

10. An apparatus for holding one or more workpieces of various shapes comprising:

an open cell defining a volume containing a magnetorheological fluid into which one or more workpieces are partially immersed said open cell having:

a first U-shaped frame member surrounding a first cell wall on three sides;

a center U-shaped frame member; and a second U-shaped frame member surround a second frame cell wall on three sides;

said first U-shaped frame member and said second U-shaped frame members secured to said center U-shaped frame member on opposite sides such that said first cell wall, said second cell wall, and a portion of the surface of said center U-shaped frame member define said volume; and a magnet configured to selectively apply a magnetic field to said magnetorheological fluid in said volume of said open cell to solidify said magnetorheological fluid in response to the application of said magnetic field, thereby immobilizing said one or more workpieces.

11. The holding apparatus of claim 10 wherein a first compressible member is fitted between said first U-shaped frame member and said center U-shaped frame member, and a second compressible member is fitted between said second U-shaped frame member and said center U-shaped frame member, said first and second compressible members forming fluid barriers between said respective frame members.

12. The holding apparatus of claim 10 wherein said first and second cell walls are composed of a magnetic material.

13. The holding apparatus of claim 10 wherein each of said U-shaped frame members is composed of a non-magnetic material.

14. The holding apparatus of claim 10 wherein said first cell wall is in contact with a first pole of said magnet, and said second cell wall is in contact with a second pole of said magnet.

15. The holding apparatus of claim 14 wherein said magnet, said first cell wall, said magnetorheological fluid, and said second cell wall define a closed magnetic circuit.

16. A method for immobilizing a workpiece comprising the steps of:

seating a workpiece at a desired orientation and position in a fixture;

immersing said fixture and a portion of said workpiece in a magnetorheological fluid; and applying a magnetic field to said magnetorheological fluid to cause said magnetorheological fluid to undergo an increase in viscosity in response to said magnetic field and apply a uniform holding force to said fixture and said workpiece.

17. A method for immobilizing a workpiece comprising the steps of:

seating a workpiece at a desired orientation and position in a fixture;

immersing said fixture and a portion of said workpiece in a magnetorheological fluid;

applying a magnetic field to said magnetorheological fluid to cause said magnetorheological fluid to undergo an increase in viscosity in response to said magnetic field and apply a uniform holding force to said fixture and said workpiece; and applying a compressive force to said increased viscosity magnetorheological fluid to further increase the uniform holding force applied to said fixture and said workpiece.

18. The method of claim 17 wherein said compressive force is applied in the direction of the magnetic field.

19. The method of claim 17 wherein said compressive force is applied in a plurality of directions.

20. A method for immobilizing a workpiece comprising the steps of:

immersing a portion of said workpiece in a magnetorheological fluid;

increasing the viscosity of said magnetorheological fluid to applying a uniform holding force to said workpiece;

securing said workpiece in a desired position and orientation prior to immersion in said magnetorheological fluid; and wherein the step of securing said workpiece utilizes a perforated fixture for holding said workpiece in said desired position and orientation, said magnetorheological fluid flowing through said perforated fixture upon immersion of said workpiece.

21. A method for immobilizing a workpiece comprising the steps of:

immersing a portion of said workpiece in a magnetorheological fluid;

increasing the viscosity of said magnetorheological fluid to applying a uniform holding force to said workpiece by application of a magnetic field to said magnetorheological fluid; and further increasing the viscosity of said magnetorheological fluid by application of a compressive force to said magnetorheological fluid, whereby said uniform holding force to said workpiece is further increased.

22. The method for immobilizing a workpiece of claim 21 wherein said compressive force is applied to said magnetorheological fluid in the direction of said applied magnetic field.

23. A method for immobilizing a workpiece comprising the steps of:

immersing a portion of said workpiece in a magnetorheological fluid;

applying a magnetic field to said magnetorheological fluid to cause said magnetorheological fluid undergoing an increase in viscosity in response to said magnetic field and apply a uniform holding force to said workpiece; and applying a compressive force to said increased viscosity magnetorheological fluid to increase the uniform holding force applied to said workpiece.

24. A method for increasing the viscosity of a magnetorheological fluid exposed to a directional magnetic field, the method comprising the step of applying a compressive force to said magnetorheological fluid in the direction of said magnetic field.

25. A method for immobilizing a workpiece comprising the steps of:

locating a workpiece at a desired position and orientation in an open cell;

conforming a deformable packet encapsulating magnetorheological fluid between a surface of said workpiece and said open cell;

applying a magnetic field to said encapsulated magnetorheological fluid to cause said encapsulated magnetorheological fluid to undergo an increase in viscosity in response to said magnetic field and apply a uniform holding force between said workpiece surface and said open cell; and applying a compressive force to said deformable packet encapsulating said magnetorheological fluid to cause said encapsulated magnetorheological fluid to undergo a further increase in viscosity responsive to said compressive force so as to increase the uniform holding force applied between said workpiece surface and said open cell.

26. An apparatus for holding at least one workpiece comprising:

an open cell containing magnetorheological fluid;

a fixture having a plurality of workpiece holding elements for securing the at least one workpiece in a desired position and orientation at least partially immersed in the magnetorheological fluid within the open cell;

a magnet for applying a magnetic field to the magnetorheological fluid to increase the viscosity of the magnetorheological fluid and apply a uniform holding force to the at least one workpiece; and a compression element for compressing the increased viscosity magnetorheological fluid to further increase the viscosity of the magnetorheological fluid as well as the uniform holding force to the at least one workpiece.

* * * * *